United States Patent [19]

Bagwell et al.

[11] Patent Number: 4,880,111

[45] Date of Patent: Nov. 14, 1989

[54] SCRUB BRUSH PACKAGE

[75] Inventors: James T. Bagwell, Anaheim; Blair E. Howe, Rancho Santa Margarita, both of Calif.

[73] Assignee: Cimco, Inc., Costa Mesa, Calif.

[21] Appl. No.: 250,713

[22] Filed: Sep. 28, 1988

[51] Int. Cl.[4] ..... B65D 81/24

[52] U.S. Cl. ..... 206/209.1; 206/362.2

[58] Field of Search ..... 206/209.1, 209, 362.1, 206/362.2, 362.3, 364

[56] References Cited

U.S. PATENT DOCUMENTS

| | | | |
|---|---|---|---|
| D. 240,677 | 7/1976 | Thompson | D4/25 |
| 1,602,531 | 10/1926 | Itoh . | |
| 2,508,773 | 5/1950 | Reichmuth | 206/209.1 |
| 2,547,779 | 4/1951 | Renyck | 206/56 |
| 2,971,851 | 2/1961 | Kurtz | 99/171 |
| 3,035,300 | 5/1962 | Wattles | 15/563 |
| 3,345,988 | 10/1967 | Vitello | 128/349 |
| 3,826,259 | 7/1974 | Bailey | 128/269 |
| 3,835,834 | 9/1974 | Brown et al. | 128/2 |
| 3,954,174 | 5/1976 | Kraus | 206/223 |
| 3,967,728 | 7/1976 | Gordon et al. | 206/364 |
| 4,211,323 | 7/1980 | Olsen | 206/210 |
| 4,269,310 | 5/1981 | Uson | 206/210 |
| 4,458,811 | 7/1984 | Wilkinson | 206/219 |

OTHER PUBLICATIONS

Page 4, Catalog of Seamless Division of Professional Medical Products, Inc.

*Primary Examiner*—Joseph Man-Fu Moy

*Attorney, Agent, or Firm*—Poms, Smith, Lande & Rose

[57] ABSTRACT

A longitudinal surgical scrub brush is packaged in a sealed compartment formed by two thin, flexible sheets which also include an aseptic solution containing chamber adjacent the head of the brush. The head of the brush is configured to facilitate rupture of the seal between the brush containing compartment and the separate solution compartment to allow the brush to be manipulated by the handle and to cause the head of the brush to be inserted into the solution containing compartment, thereby absorbing solution only on the bristles and sponge carried on the brush head. The brush with its head containing the absorbed solution may be withdrawn from the package by the handle, which remains free of solution, and the brush may continue to be manipulated by this solution free handle.

23 Claims, 2 Drawing Sheets

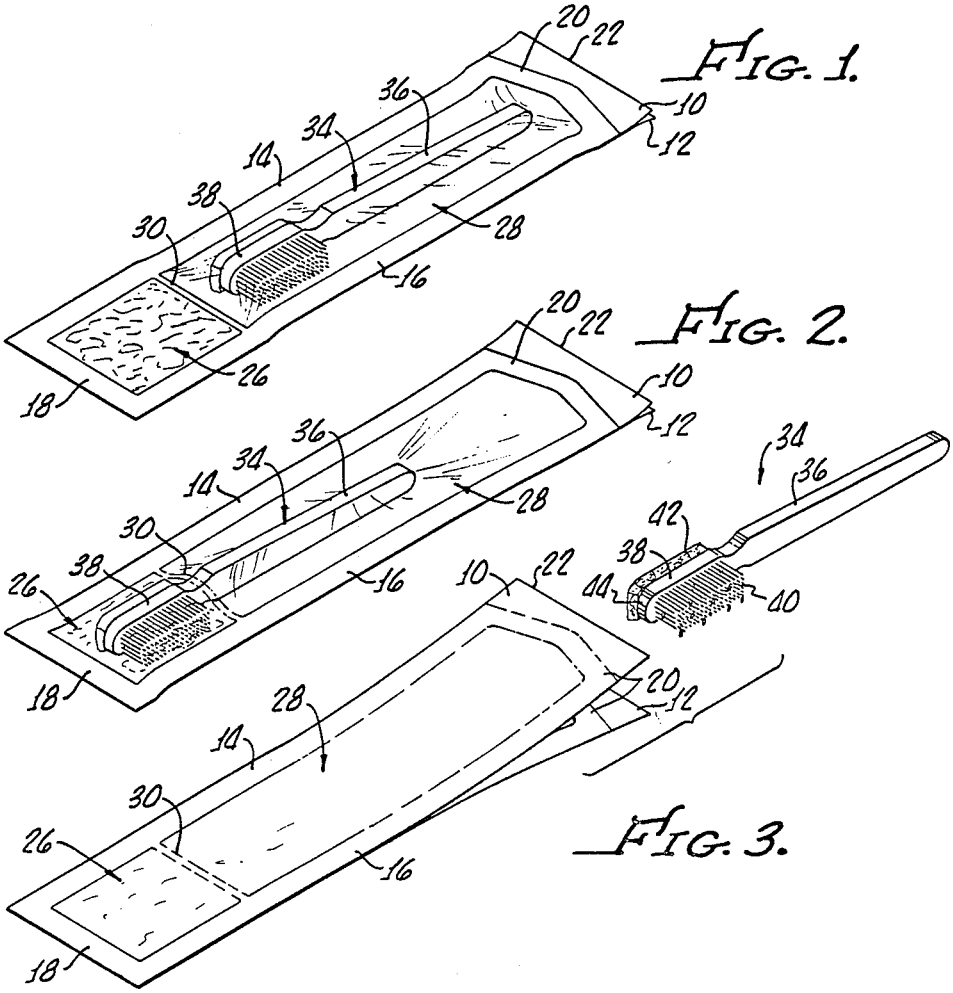
FIG. 1.
FIG. 2.
FIG. 3.
FIG. 6a. FIG. 6b. FIG. 6c. FIG. 6d. FIG. 6e.
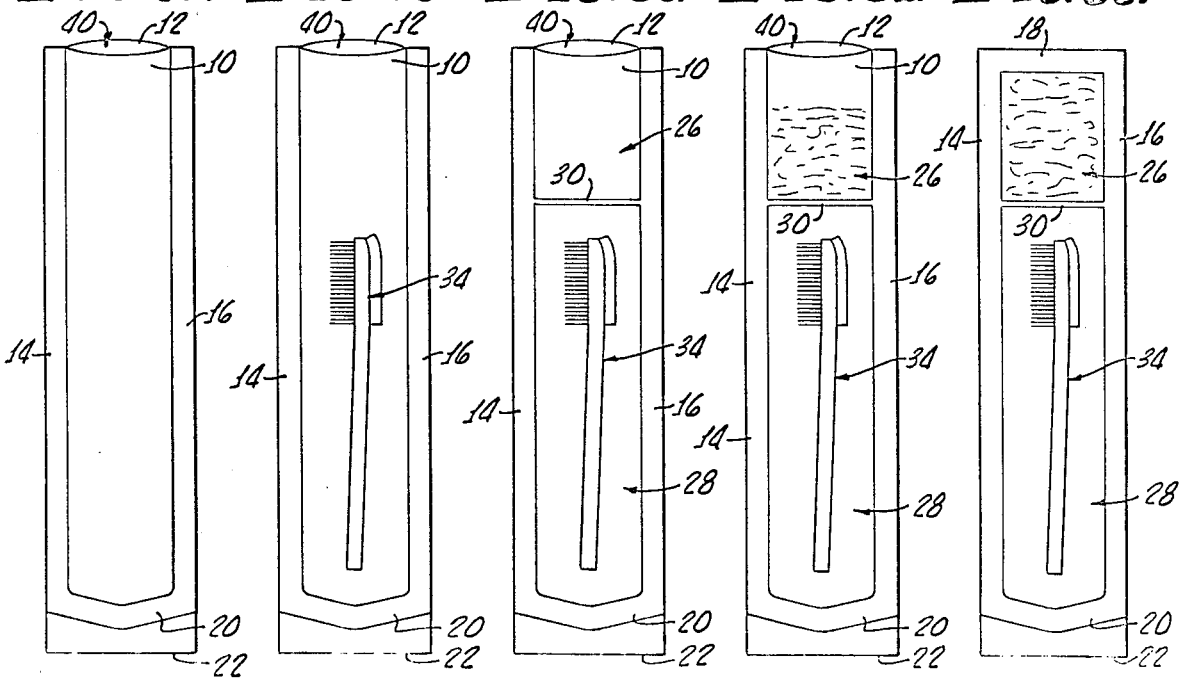

SCRUB BRUSH PACKAGE

BACKGROUND OF THE INVENTION

The present invention relates to material packages, and more particularly concerns a disposable package in which an object contained in one sealed compartment is configured to be employed for rupture of a seal of a second compartment to facilitate application of the object in the first compartment to the material in the second compartment.

Many types of scrubs, swabs and combinations of scrubs and antiseptic solutions have been provided in sterile packages. In some, a relatively large scrub brush is impregnated with a desired solution, and the solution bearing brush is packaged in a sealed, flexible package. These devices are relatively large and messy to use, since the solution, often an iodine solution, covers all or most of the exterior surface of the brush so that it is not possible to open the package or handle the brush without contact with the solution.

Other types of instruments have been packaged in compartmentalized arrangements which generally require the user to manipulate the solution containing compartment to break a sealed ampule or rupture a seal that will release the solution. Upon release the solution is free to randomly flow throughout the remainder of the package and will contact various parts of the object in the remainder of he compartment. No control over the area of contact between the object and the solution is available. Other packages employ methods of solution release which include tearing a rip-seal or unfolding or removing a clamping device. Multi-compartment packages generally employ a number of different elements to form the package and seal between the compartments, including separate sealing of the individual compartments, and thus are complex and expensive to assemble. Packages that do not have separate compartments for the solution to be applied to the brush generally require a relatively large and excessive amount of solution in the package. In those prior packages where solution is separately contained, it is more difficult to rupture the solution package and more difficult, if not impossible, to control application of the solution to the brush.

Accordingly, it is an object of the present invention to provide a package of brush and a material for application to the brush that avoids or minimizes above-mentioned problems.

SUMMARY OF THE INVENTION

In carrying out principles of the present invention in accordance with a preferred embodiment thereof, a disposable scrub brush package is formed of first and second flexible sheets in face to face juxtaposition, with the sheets sealed to one another to form a peripheral seal that defines a sealed compartment between the sheets. A sealed, breakable partition extends across the compartment, separating the compartment into first and second chambers, in the first of which is sealed the scrub brush, and in the second of which is sealed a fluid material, such as a liquid paste, ointment, powder or the like.

According to a feature of the invention, a scrub brush has a handle connected to a head which is positioned adjacent the partition and configured to facilitate rupture of the partition by grasping of the handle and manipulating the brush head to force the head end of the brush against the partition while the peripheral seal remains unbroken. According to another feature of the invention, the package is assembled from from first and second thin, flexible sheets which are sealed along their peripheries to form a package having an opening. The sheets are maintained in a somewhat vertical position, and the long handled brush is inserted into the compartment formed by the sheets. A barrier seal is formed to separate the compartment into a first chamber encompassing the brush and a second chamber which receives a material that is to later be applied to the brush. The compartment opening is sealed to provide a sealed package that enables the brush and handle in the first chamber to be manipulated to cause the brush head to rupture the barrier seal and enter the second chamber for application of the confined material to the brush while the brush and material are within the second chamber.

BRIEF DESCRIPTION OF THE DRAWINGS

FIG. 1 is a perspective illustration of a sealed, sterile scrub brush package embodying principles of the present invention;

FIG. 2 illustrates a still sealed package with the head of the brush inserted through the ruptured partition into the solution containing chamber;

FIG. 3 illustrates removal of the solution containing brush from the package;

FIGS. 6*a* through 6*e* illustrate a series of steps in manufacture of the scrub brush package.

DETAILED DESCRIPTION OF THE INVENTION

Figure 4:
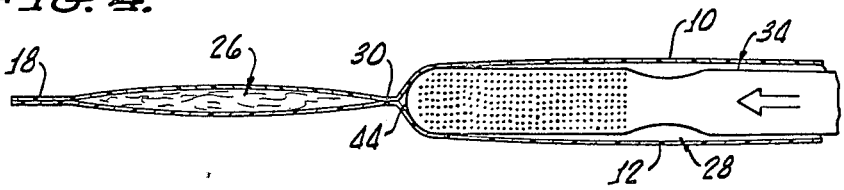
FIG. 4 is an enlarged sectional fragmented view showing the head of the brush being pushed against the barrier seal.
Figure 5:
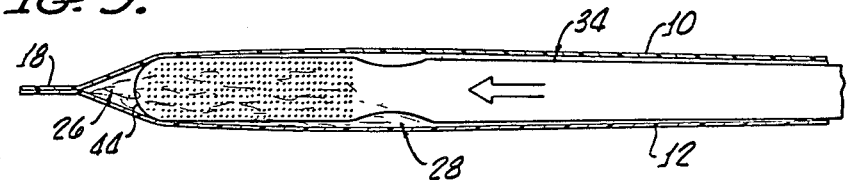
FIG. 5 is a view like that of FIG. 4 showing the head of the brush after entry into the solution containing compartment.

As illustrated in FIGS. 1 through 5, a package embodying principles of the present invention is formed of first and second thin, flexible sheets 10 and 12 of generally elongated rectangular configuration. At least the first or top sheet 10 is transparent for easy visibility of the package contents. The second or bottom sheet 12 need not be transparent, but instead may have printed thereon various types of information concerning the package and contents, including a set of instructions relating to its use. The two sheets form a pealable package. That is, they are sealed to one another around peripheral side edges 14,16 and end edges 18,20. The seal 20 at the one end edge is spaced from the ends 22 of the sheets, which thus are not adhered to one another and may be grasped to pull apart the sheets and at least partially destroy the peripheral seals 14,16,18,20 when the brush is to be removed from the package.

Peripheral seals 14,16,18,20 define a sealed elongated compartment between the sheets 10 and 12. This compartment is separated into two mutually sealed chambers 26,28 by a barrier seal or partition 30 extending transversely across the elongated compartment from one side edge seal 14 to the other side edge seal 16. In a preferred embodiment the barrier seal 30 directly connects the two sheets to one another. In such an embodiment the sheets are made of a conventional plastic packaging material, and the peripheral seals and barrier seals are heat seals formed by pressing the two sheets together along the seal areas at elevated temperature of the seal areas.

Completely contained and sealed within the sealed chamber 28 is a long handled scrub brush 34, having a handle 36 and a brush head 38 integrally formed therewith. One side of the brush head has a plurality of projecting bristles 40 (FIG. 3), and the other side has fixedly secured an absorbent sponge pad 42. Importantly, the forward edge of the brush head 38 is rounded, as indicated at 44. The brush head is rounded in a plane perpendicular to the general surface extent of the two sheets of the package and containing the longitudinal axis of the elongated brush and its handle (e.g. in the plane of the drawing in FIGS. 4 and 5). Thus one side of the rounded head configuration 44, the upper side for example, may be adapted to press against the inner surface of the upper sheet 10, and the lower side of the rounded brush head end is adapted to press against the inner surface of the lower sheet 12. This is more particularly illustrated in FIG. 4. The rounded configuration allows the head to be used to rupture the barrier seal, but presents no sharp edges or corners that might tear either of sheets 10,12 as the seal 30 is broken. Further, seal 30 is relatively narrow, being considerably narrower than the peripheral seal, so as to ensure that the barrier seal may be broken without either tearing sheets 10,12 or breaking any peripheral seal.

Confined and sealed within the chamber 26 is a fluid material which may be a suitable liquid, paste, ointment, powder or the like. In a particular embodiment described herein for purposes of illustration, the brush is arranged for use as a surgical scrub brush for application to small wounds. In this embodiment, the fluid material in compartment 26 is a topical antiseptic, such as providine iodine. Obviously other solutions and material may be employed. The entire package, sheets 10,12 and the brush are disposable.

The brush head, with the bristles protruding from one side and the absorbent pad 42 on the other, has a lateral dimension (as measured in a plane substantially parallel to the plane of the packing sheets 10 and 12) that is greater than its transverse dimension from one edge of the brush to the other (as measured in a direction perpendicular to the plane of the packing sheets). Thus the brush is most conveniently packaged with this lateral dimension parallel to the packing sheet, as illustrated in the drawings. With the brush thus oriented and positioned within the compartment or chamber 28, lying on its side, the rounded end 44 of the brush head is positioned adjacent the barrier seal 30 and is oriented so that motion of the brush toward and against the barrier seal to the position illustrated in FIG. 4, for example, will cause the rounded end 44 of the brush head to press both upwardly and downwardly (as viewed in FIG. 4) against the package sheets 10,12 at their junction at barrier seal 30. This forces the two sheets apart and will effectively and easily rupture the barrier seal 30, enabling the brush head to enter or chamber 26.

Manipulation of the brush to rupture the barrier seal 30 and insert the brush head into the solution containing chamber 26 is preferably performed with the chamber 26 at a lowermost portion of the package so that the solution remains within the lower portion of the compartment defined between the two packing sheets, and is concentrated in a small area around the head of the brush. Thus the absorbent pad and bristles may most readily absorb the solution, and flow of the solution is controlled and limited to the brush head. None of the solution will contact the handle. In the course of this operation the brush is manipulated through the two sheets 10 and 12 as the peripheral seal 14,16,18,20 has not been disturbed. Thus with the brush head within the chamber 26 the brush handle 36 is still sealed within the package. After having manipulated the brush through the still sealed package to cause the bristles and absorbent pad of the brush to absorb the fluid in the chamber 26, and still maintaining the brush head and fluid lowermost, the pealable package is opened at its end seal 20, and the brush handle 36 is grasped by the user to remove the entire brush with the aseptic material in its pad and bristles from the package in an upward direction. The brush may then be used in any desired manner, as for example by applying the solution to a wound by contacting the wound with the pad 42 and then employing the bristles to further cleanse the wound.

It will be noted that the aseptic solution is employed in a most efficient manner. A minimum amount of solution is employed, and it is all concentrated and confined within a small chamber into which the small brush head, but not the majority of the handle, is inserted for applying the solution just to the brush head, bristles and pad but not to the handle.

A relatively large amount of solution may be confined in the relatively small chamber 26. This arrangement is facilitated by ensuring that assembly of the package is carried out with the sheets 10 and 12 in a generally vertical position. Thus in a presently preferred method of assembly, the sheets 10 and 12 are first positioned against one another and sealed around peripheral side edges to form side edge seals 14, 16, and 20 (FIG. 6*a*). The end seal 18 of FIG. 1 is not formed, and thus an opening 40 remains at one end of the compartment formed between the sheets 10 and 12. The sheets are held in a generally vertical position with opening 40 facing upwardly and ends 22 at the bottom, and the brush 34 is inserted downwardly through the opening into the compartment, with the handle pointing downwardly and the brush head upwardly, as shown in FIG. 6*b*. Then the intermediate partition or barrier seal 30 is formed between the sheets 10,12 adjacent the head of the brush. Now the desired solution is placed into the chamber 26 formed at the top end of the assembly between the side peripheral side edge seals 14,16 and the barrier seal 30. Thereafter the final end seal 18 is formed, and the package is completed. The pre-assembly of sheets 10 and 12 could be reversed, end for end, with opening 40 formed at the pealable end, where seal 20 is to be made. The solution would be inserted first, the seal 30 formed, and lastly, the brush would be inserted head down before the top seal 20 is formed. In such a method of assembly it may be more difficult to keep the solution from contact with the sides of the brush chamber during assembly.

Figure 7A:
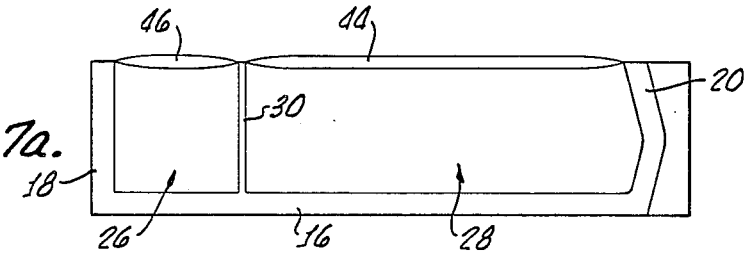
FIGS. 7*a* through 7*d* illustrate a series of steps in a modified form of manufacture of the scrub brush package.
Figure 7B:
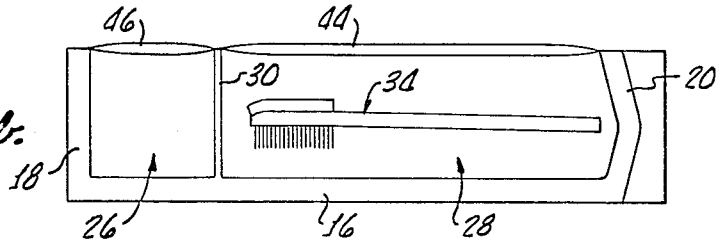
Figure 7C:
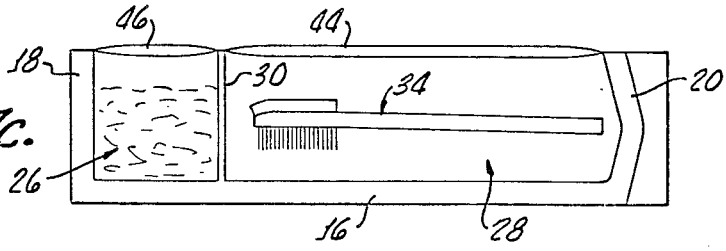
Figure 7D:
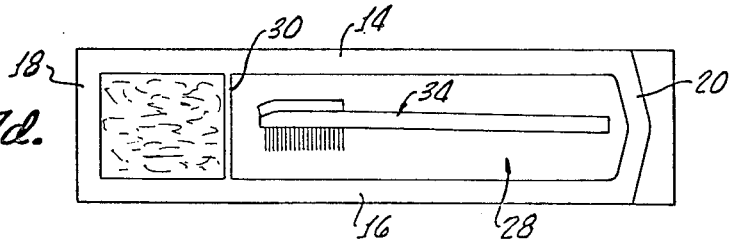

Another alternative method of assembly of the package is illustrated in FIGS. 7*a*–7*d*, still employing sheets held in a vertical position during assembly of the package. The planes of the two sheets are vertical (the transverse sheet dimension is vertical), although the sheets are oriented at 90° C. relative to the sheet orientation of the method illustrated in FIGS. 6*a*–6*c* in which the longitudinal sheet dimension is vertial. The sheets 10 and 12 are initially connected to each other to form a first side edge seal 16 and end edge seals 18 and 20. The intermediate partition or barrier seal 30 is also formed between the sheets. This leaves the sheets with a pair of upwardly facing openings 44 and 46 at upper ends of chambers 28 and 26, as illustrated in FIG. 7*a*. With the partly assembled sheets held in vertical position, as illustrated in FIG. 7*a*, and openings 44 and 46 facing upwardly, the brush and solution are placed into the chambers 28 and 26 respectively, as illustrated in FIGS. 7*b* and 7*c*. Then the openings 44,46 are sealed to provide the side edge seal 14, as in FIG. 7*d*.

It will be readily appreciated that the described sterile package of scrub brush and aseptic solution in separate sealed compartments is simple to manufacture, presents a neater appearance, and is more readily and conveniently used. The contents of the package are readily visible through the transparent sheet 10. The aseptic solution, particularly where a dark colored iodine solution is employed, is confined to a limited area of the compartment and does not in any way contact, cover or otherwise change the appearance of the brush or its handle. The total amount of solution contained may be readily estimated by observation. As the two sheets of the package are flexible, the package may be folded about either end of the brush to provide a more compact arrangement for transportation and handling. By using a smaller chamber 26 for confining the solution, the amount of solution employed may be precisely metered, and a smaller amount of solution is needed. Again no solution is wasted by application of solution to the handle as would be the case if the solution were not separately confined in chamber 26. If a separate chamber for confining the solution were not provided, the solution would flow through the entirety of the chamber 28 and contact various parts of the brush, including all of the handle, thus wasting a great deal of solution in addition to making the arrangement less convenient for handling and use by the operator.

When the brush is to be used, the user grasps the brush handle through the thin, flexible packing sheets, without breaking any part of the peripheral seal 14,16,18,20, holding the package with the chamber end 26 downwardly, and manipulates the handle to push the brush head toward the barrier seal 30. The user forces the brush head round end 44 against the barrier seal to rupture the seal and push the entire head of the brush into the chamber 26, where the brush head and package are manipulated through the solution so as to ensure full application of the fluid solution to the absorbent pad and bristles. By holding the package vertically when manipulating the brush handle to cause the brush head to rupture the seal, retention of the aseptic fluid material in the chamber 26 is ensured, and application of the fluid to the brush bristles and pad is analogous to merely dipping the brush head vertically downwardly into a standing container of the solution. The solution will contact the brush pad and bristles only to the extent that the brush head is moved downwardly into the confined body of solution, and no unwanted solution will be able to contact parts of the handle which remain upwardly, above the upper surface of the solution contained in the chamber.

Now the pealable package may be opened at its pealable end (which is still held uppermost so as to keep the solution at the lower end of the package) by separating the ends 22 and first breaking end seal 20. This exposes the end of the handle 36 which may then be grasped to remove the entire brush and its solution bearing bristles and pad from the package for desired use. Note that substantially all of the solution that is applied to the brush has been applied to the brush head, to its bristles and pad, and not to its handle, which is free of the solution and thus may be more conveniently and readily grasped and manipulated. After use, the brush and package are discarded.

Accordingly, it will be seen that there has been disclosed a disposable scrub brush and package which are simple, efficient and effective in operation and are made by simple assembly procedures involving the two packaging sheets.

The foregoing detailed description is to be clearly understood as given by way of illustration and example only, the spirit and scope of this invention being limited solely by the appended claims.

We claim:

1. A method of applying a material to an object having an elongated handle, and thereafter causing said object to transport said material and apply said material to a region of use, said method comprising the steps of:

juxtaposing first and second thin, flexible, unmolded plastic packaging sheets to one another, sealing said sheets to one another along their peripheries to form a package having a packaging compartment and having an opening, inserting an object having an elongated handle into said compartment, in such manner that an end of said object remote from said handle thereof is disposed at an intermediate portion of said compartment, said object incorporating, at a region adjacent said end thereof, a combination material-transporting and material-application means that is distinctly different from said handle, said end of said object not being sharp.

forming a barrier seal between said sheets, by pressing said sheets together, adjacent said object end to divide said compartment into a first chamber and a second chamber, said first chamber containing said object and said handle thereof.

inserting into said second chamber a material to be applied to said combination material-transporting and material-application means, sealing said opening, manipulating said object and handle in said package to cause said end to force said sheets apart at said barrier seal and thus rupture said barrier seal and enter said second chamber, said manipulating step being such that said end and at least part of said combination material-transporting and material-application means pass through said ruptured barrier seal and at least partially enter said second chamber.

applying a desired amount of said material to said material-transporting and material-application means while said material and at least part of said combination material-transporting and material-application means are within said second chamber, completely removing said object from said package, in such manner that said end and said combination material-transporting and material-application means pass through said ruptured barrier seal, in a relative direction that is the reverse of that which was followed during said rupturing, said thereafter transporting said material-bearing object to a point of application and applying said material to a desired region of use.

2. The method of claim 1 wherein said sheets are generally elongated, having relatively short end edges and relatively long side edges, and wherein said opening is formed in one of said side edges.

3. The method of claim 1 wherein said sheets are generally elongated, having relatively short end edges and relatively long side edges, and wherein said opening is formed in one of said end edges.

4. The method of claim 1 wherein said sheets are positioned at a substantial angle to the horizontal while said material is inserted into said second chamber.

5. The method of claim 3 wherein said sheets are positioned with said one end edge uppermost while said object and material are inserted.

6. The method of claim 5 wherein said barrier seal is formed after said object is inserted and before said material is inserted.

7. The method of claim 2 wherein said one side edge is uppermost while said object and material are inserted.

8. The method of claim 1 including the step of forming said end of said object adjacent said barrier seal with a configuration that facilitates rupture of said barrier seal.

9. The method of claim 1 including the step of manipulating said object and handle to rupture the barrier seal before any of said seals other than said barrier seal is broken.

10. The method of claim 1 wherein the sheets and compartment are positioned vertically, with the second chamber lowermost, while the object and handle are manipulated to rupture said barrier seal, whereby said object end may be dipped downwardly into said second chamber and the material contained therein.

11. A scrub brush package comprising:

first and second flexible sheets in face to face juxtaposition, means for sealing said sheets to one another to form a peripheral seal that defines a sealed compartment between the sheets, a sealed, breakable partition extending across said compartment and separating the compartment into first and second sealed chambers, a scrub brush sealed in said first chamber, said scrub brush comprising a brush head having a handle attached thereto, said brush head having a head end adjacent said partition that is configured to facilitate rupture of said partition by grasping of the brush handle through the flexible sheets of the sealed compartment and forcing the head end of the brush against the partition while the peripheral seal remains unbroken, said brush head having a hard base portion having a set of bristles on one side thereof and a body of sponge material on the other side thereof, and a fluid material sealed within said second chamber, said fluid material being a solution of liquid antiseptic, whereby the brush head base portion may be pressed against the partition to rupture the partition and whereby the sponge material and bristles may be forced through the partition with the base portion to contact the liquid antiseptic and cause the liquid antiseptic solution to be absorbed by the sponge material and bristles, means on said sheets to facilitate separation of the sheets from one another at an end portion of the compartment remote from said brush head to enable removal of the scrub brush with the absorbed solution.

12. The package of claim 11 wherein the partition is formed by a sealing connection directly between said sheets, and wherein the brush head has a rounded end adjacent the sealing connection to enable the brush end to be forced against the partition between connected sheets and to enter the second chamber without unsealing said sealed compartment, and without tearing either of said sheets.

13. The package of claim 12 wherein the rounded end of the brush is rounded in a plane transverse to the plane of said sheets, whereby the rounded end may be manipulated to pry apart said sheets at the partition to enable entry of the brush head into the second chamber.

14. A surgical scrub brush package comprising:

first and second elongated sheets of thin, flexible material, a pealable perimeter seal connecting the sheets to each other along side and end edges to form a sealed compartment between the sheets, said sheets being connected and sealed to one another to form a transverse barrier seal extending across said sheets to separate said compartment into first and second sealed chambers, an aseptic solution in said first chamber, a surgical scrub brush in said second chamber, said scrub brush having an elongated handle, said handle being remote from said barrier seal in comparison to the brush end of said surgical brush, means on said brush for breaking said barrier seal while said sealed compartment remains sealed to enable entry of at least a portion of said brush into said first chamber to apply the solution to the brush, and means at the end portion of said sheets that is remote from said barrier seal, and is adjacent the end of said handle remote from said brush end of said brush, to open said second chamber and thus permit removal of said brush having solution thereon.

15. The package of claim 14 wherein said sheets are formed of initially flat material, and wherein the brush has a head positioned adjacent the barrier seal, and an elongated handle connected to the head, said means for breaking said barrier seal comprising a rounded end on said head, said rounded end being adjacent said barrier seal, and being rounded in a plane perpendicular to the plane of said sheets, whereby the handle may be grasped through the thin, flexible sheets and manipulated to force the rounded end of the brush head against the barrier seal to force the sheets apart, to rupture the barrier seal and insert the brush head into the solution contained in the first chamber.

16. The package of claim 14 wherein said brush has a head having bristles on one side thereof and an absorbent pad on the other side thereof, and wherein the brush is positioned on its side within the first chamber, said means for breaking the barrier seal comprising a rounded end on said brush head, being rounded in a plane extending between the bristles and absorbent pad, to enable the rounded end to be forced between the sheets at the barrier seal to break the barrier seal.

17. The package of claim 16 wherein one of said sheets is transparent so that manipulation of the brush to rupture the barrier seal may be observed and controlled.

18. The method of claim 1 wherein said object is inserted before said barrier seal is formed and before said material is inserted and wherein said first chamber is below said second chamber while said material is inserted.

19. The method of claim 1 wherein said material is inserted before said barrier seal is formed and before said object is inserted, and wherein said second chamber is below said first chamber while said material is inserted.

20. The method as claimed in claim 1, in which said sealing step is performed in such manner that unsealed regions remain at the end of said package remote from said second chamber, said unsealed regions being outside of sealed regions and serving as starting points for separation of said sheets, and in which said object-removing step includes separating said sheets at said first chamber.

21. The method as claimed in claim 1, in which said object inserting step is performed subsequent to said barrier seal-forming step.

22. A material application package comprising:

first and second elongated sheets of thin, flexible plastic material, a peelable perimeter seal connecting the sheets to each other along side and end edges to form a sealed compartment between the sheets, said sheets being connected and sealed to one another to form a transverse barrier seal extending across said sheets to separate said compartment into first and second sealed chambers, said first chamber containing a material to be transported and applied at a location remote from said package, said second chamber containing an object having an elongated handle, said object incorporating, at a region, adjacent an end thereof, a combination material-transporting and material-application means that is distinctly different from said handle, said end of said object being positioned adjacent said barrier seal and not being sharp, said handle being remote from said barrier seal in comparison to said end of said object, means on said object at said end thereof for forcing said sheets apart at said barrier seal and thus rupture said barrier seal while said sealed compartment remains sealed, to enable entry of at least a portion of said combination material-transporting and material-application means into said first chamber to apply said material thereto; and means at the end portion of said sheets that is remote from said barrier seal and is adjacent the end of said handle remote from said combination material-transporting and material-application means to open said second chamber and thus permit removal of said object having at least some of said material applied thereto.

23. The material application package of claim 22 wherein said barrier seal is considerably narrower than said perimeter seal to enable the barrier seal to be broken without either tearing the sheets or breaking the perimeter seal.

* * * * *